US005326102A

United States Patent [19]

Chang

[11] Patent Number: 5,326,102

[45] Date of Patent: Jul. 5, 1994

[54] QUICKLY ASSEMBLED KNOCKDOWN FOOTBALL TABLE

[76] Inventor: Charles Chang, C/O Hung Hsing Patent Service Center, P.O. Box 55-1670, Taipei (104), Taiwan

[21] Appl. No.: 103,201

[22] Filed: Aug. 9, 1993

[51] Int. Cl.[5] ..... A63F 7/36

[52] U.S. Cl. ..... 273/85 D; 108/50; 312/257.1

[58] Field of Search ..... 273/85 R, 85 D; 108/28, 108/50, 153, 156, 160; 312/108, 257.1, 265.4, 265.5, 265.6, 351.3

[56] References Cited

FOREIGN PATENT DOCUMENTS

| | | | |
|---|---|---|---|
| 627688 | 5/1963 | Belgium | 273/85 D |
| 659837 | 6/1965 | Belgium | 273/85 D |
| 707649 | 4/1965 | Canada | 273/85 D |
| 1285853 | 1/1962 | France | 273/85 D |
| 1392712 | 2/1965 | France | 273/85 D |
| 870129 | 6/1961 | United Kingdom | 273/85 D |

*Primary Examiner*—Vincent Millin
*Assistant Examiner*—Sebastiano Passaniti

[57] ABSTRACT

A football table for playing purpose includes: a bottom plate embedded in between a pair of end panels and a pair of side panels secured to the two end panels to form a football playing field generally rectangular shaped, having a plurality of packing sleeves transversely secured on a bottom surface of the bottom plate each packing sleeve engageably riding on a fastening bolt which is passed through the two side panels, and the packing sleeve for firmly fastening the two side panels with the bottom plate for quickly assembling a football table from its knockdown state.

1 Claim, 7 Drawing Sheets

QUICKLY ASSEMBLED KNOCKDOWN FOOTBALL TABLE

BACKGROUND OF THE INVENTION

A conventional football or soccer table as shown in FIG. 1 is constructed by a pair of end panels 1, a pair of side panels 2, and a bottom plate 3 to form a football field (on an upper portion of the table) for simulating a football game by striking a plurality of player rods P. However, a plurality of elongate ribs R should be fixed on the side panels 2 by screws, nails or rivets for supporting a plurality of beams B transversely secured on the ribs R for supporting the bottom plate 3 by engaging each beam B with the notches N recessed in the rib R, thereby causing a very inconvenient assembly job for storage or shipping. The assembled table, whenever shipped, will increase its handling or shipping cost due to its gigantic volume.

FIG. 2 shows another conventional football table by mounting angles A in between the longitudinal edge portions of the bottom plate 3 and the side panel 2 for fixing the bottom plate 3 between the two side panels 2, and by transversely reinforcing a plurality of bolts 4 for fastening the two side panels 2 with the bottom plate 3. By riveting, screwing or fastening the angles A onto the panel 2 and the bottom plate 3, it will consume longer time and require skilled labors or technicians to finish such an assembly job, thereby causing an inconvenient assembly and increasing the production cost for assembling the football table.

SUMMARY OF THE INVENTION

The object of the present invention is to provide a football table for playing purpose including: a bottom plate embedded in between a pair of end panels and a pair of side panels secured to the two end panels to form a football playing field generally rectangular shaped, having a plurality of packing sleeves transversely secured on a bottom surface of the bottom plate each packing sleeve engageably riding on a fastening bolt which is passed through the two side panels, and the packing sleeve for firmly fastening the two side panels with the bottom plate for quickly assembling a football table from its knockdown state.

DETAILED DESCRIPTION

Figure 3:
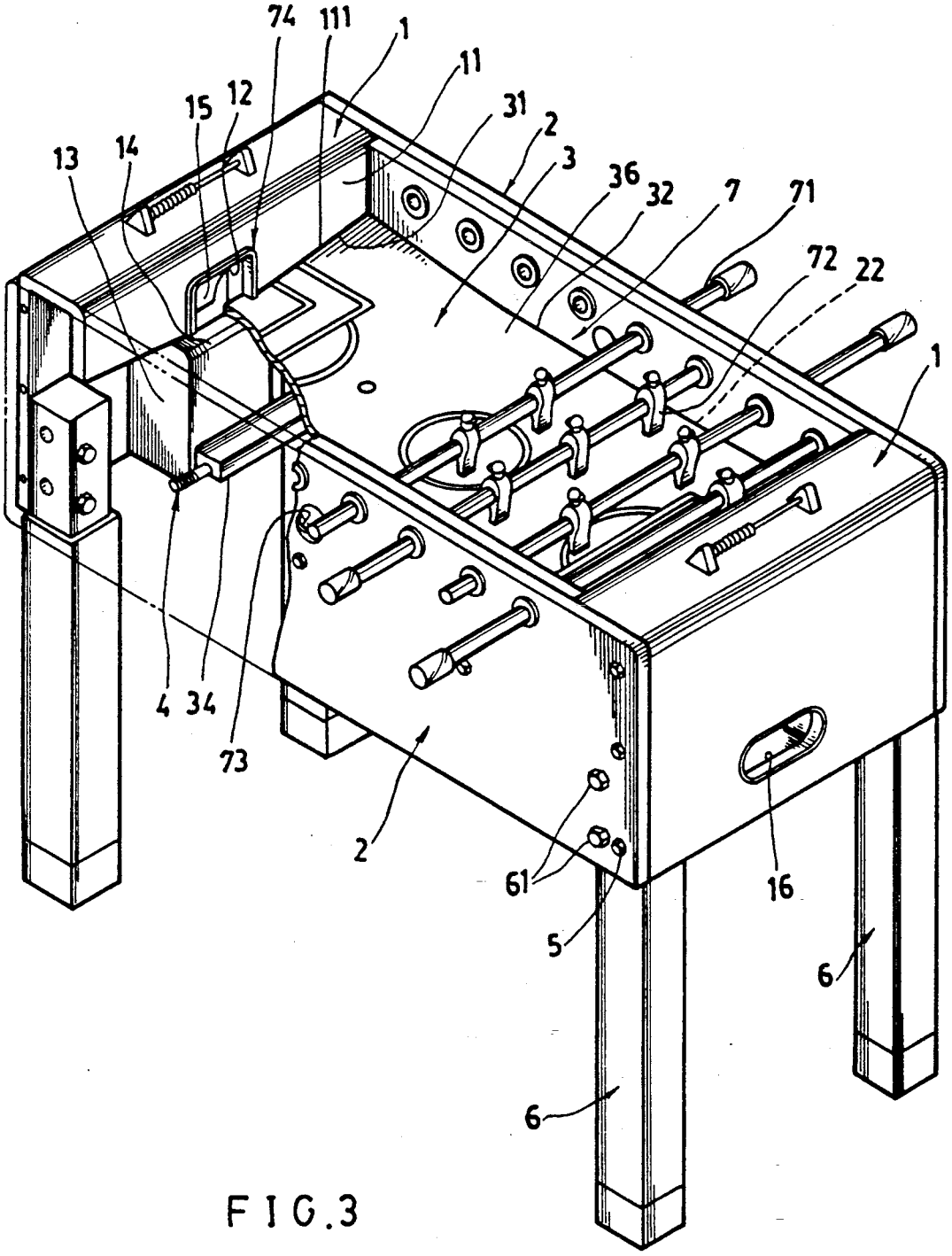
FIG. 3 is a perspective view of the present invention.
Figure 4:
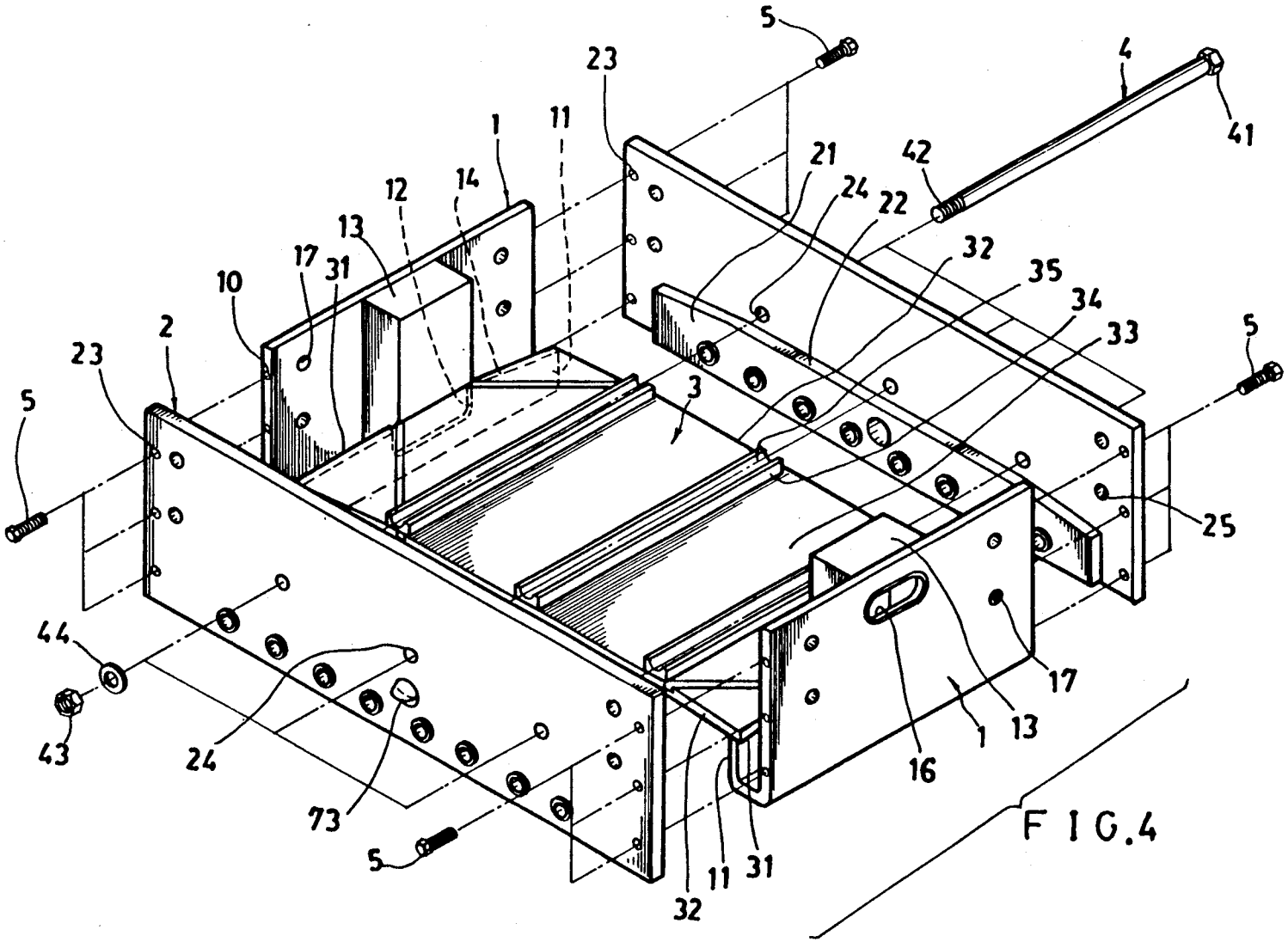
FIG. 4 is an illustration showing an assembly of the present invenion from a bottom view thereof.
Figure 5:
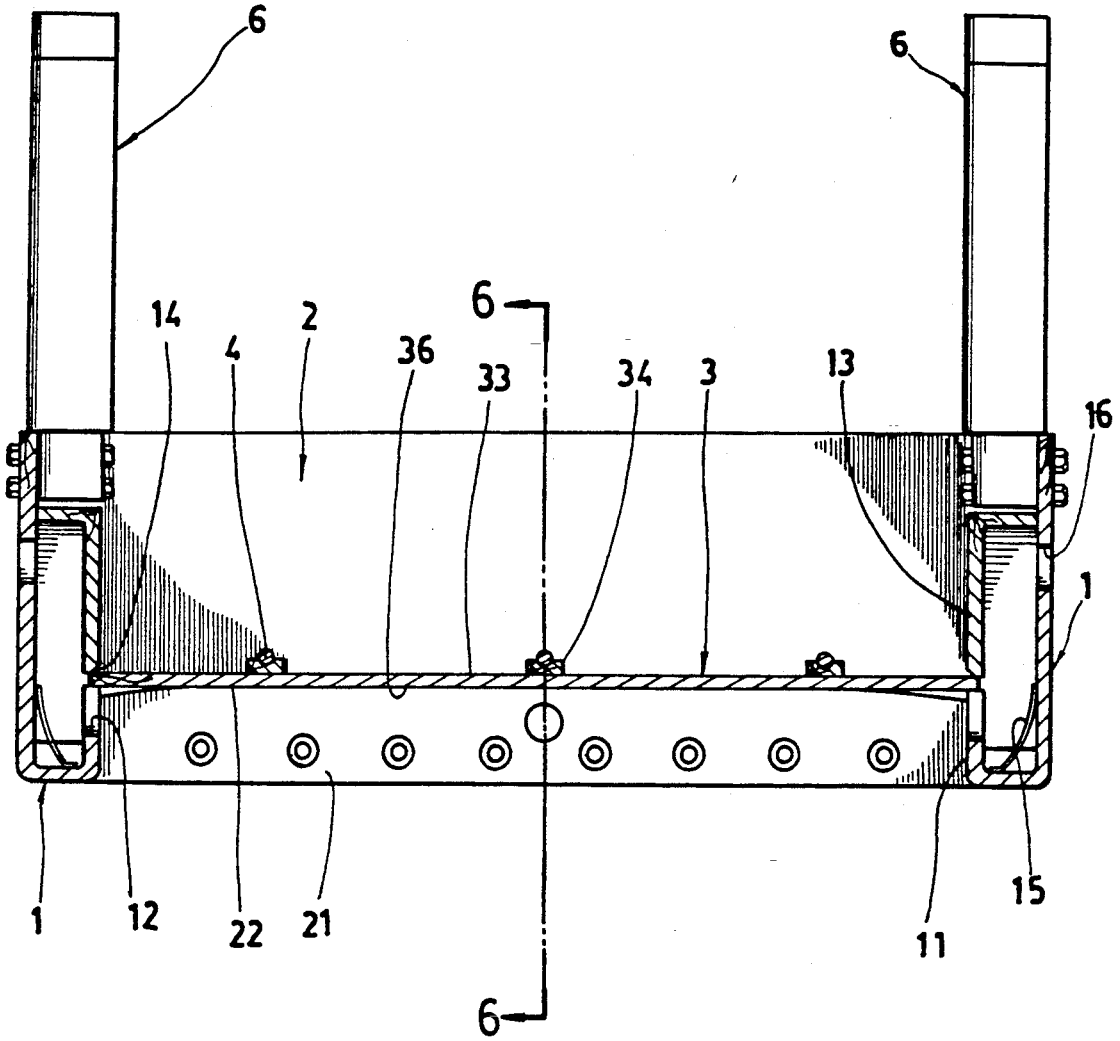
FIG. 5 is a longitudinal sectional drawing of the present invention when assembled and inverted in position.

As shown in FIGS. 3-5, a football table for playing use of the present invention comprises: a pair of end panels 1, a pair of side panels 2, a bottom plate 3 combinable with the pair of end panels 1, and the pair of side panels 2 to form a rectangular shaped football playing field 7, a plurality of fastening bolts 4 fastening the side panels 2 with the bottom plate 3, a plurality of screws 5 securing the side panels 2 with the end panels 1, and four supporting leg members 6 supporting the football table by securing bolts 61 through each leg member into the side panels 2 and into the end panels 1 for positioning each leg member 6 on each right-angle corner of the football table. A pair of entry ports 73 are provided in a middle portion of the playing field 7 for filling football or ball into the field 7 for playing purpose.

Each end panel 1 includes: an end wall portion 11 bent inwardly downwardly from a vertical panel portion of the end panel 1 to form a longitudinal section generally U shaped to contact the bottom plate 3 when assembled, a goal opening 12 notched in a goal 74 of the playing field 7 at a central portion of the end wall portion 11, a ball box 13 positioned below the end wall portion 11 and communicating with the goal opening 12 for collecting a football (not shown) shot by pushing the player rod 71 having FIGS. 72 secured thereon, a transverse slot 14 recessed inwardly in between a lower edge portion 111 of the end wall portion 11 and the ball box 13 for engageably receiving each transverse end portion 31 of the bottom plate 3, a bumper 15 resiliently held in the end wall portion 11 within the goal opening 12 serving as a buffer for the ball impacting thereupon, a pickup hole 16 formed in a rear portion of the end panel 1 for picking up the ball from the box 13, a plurality of screw holes 10 drilled in two opposite side portions of the end panel 1 to be inserted therein a plurality of the screws 5 for fixing the side panels 2 on two opposite sides of the end panel 1 by the screws 5 passing through the screw holes 23 formed in the side panels 2, and a plurality of bolt holes 17 for fixing the bolt 61 of the leg member 6 for securing the leg member 6 to the end panel 1.

Each side panel 2 includes: a reinforcing side plate 21 having a height lower than that of the side panel 2 integrally combined with the side panel 2 having a bottom edge portion 22 longitudinally formed on a bottom portion of the reinforcing side plate 21 contiguous to a longitudinal side edge portion 32 of the bottom plate 3, a plurality of screw holes 23 formed in two end portions of the side panel 2 for fixing screws 5 therein for securing the side panel 2 with the end panel 1, a plurality of fastening-bolt holes 24 drilled in the side panel 2 to be longitudinally juxtapositional to the bottom edge portion 22 of the reinforcing side plate 21 for passing a plurality of fastening bolts 4 through the fastening-bolt holes 24 for fastening the side panel 2 with the bottom plate 3, and a plurality of bolt holes 25 for passing bolts 61 for fixing a leg member 6 on the side panel 2.

The bottom plate 3 has a pair of transverse end portions 31 transversely formed on two opposite end portions of the bottom plate 3 engageable with a pair of transverse slots 14 each slot 14 recessed in between a lower edge portion 111 of an end wall portion 11 of the end panel 1 and a ball box 13 for collecting ball shot through the goal 74 of the playing field 7, a pair of longitudinal side edge portions 32 disposed on two opposite longitudinal side portions of the bottom plate 3 each longitudinal side edge portion 32 engageable with the bottom edge portion 22 of the reinforcing side plate 21 of each side panel 2 when assembling the side panel 2 with the bottom plate 3, a plurality of packing sleeves 34 transversely juxtapositionally secured on a bottom surface 33 of the bottom plate 3 each packing sleeve 34 having a groove 35 longitudinally recessed in the sleeve 34 to have a cross section of arcuate shape or semicircular shape concave inwardly towards the bottom surface 33 for snugly engaging a fastening bolt 4 with the groove 35 of the packing sleeve 34 by passing the fastening bolt 4 through the fastening-bolt hole 24 in the side panel 2, and a field surface 36 formed on an upper surface of the bottom plate 3 for marking some features such as central circle, penalty area, etc., for simulating a football field.

Each fastening bolt 4 snugly engageable with the groove 35 of the packing sleeve 34 includes a head portion 41, and a screw portion 42 opposite to the head portion 41, with the head portion 41 retained on a first side panel 2*a* when passing the fastening bolt 4 through the first side panel 2*a* to engage the groove 35 in the packing sleeve 34 and with the screw portion 42 protruding outwardly through a second side panel 2*b* to be engaged with a nut 43 and a washer 44 for fastening the second side panels 2*b* and the first side panel 2*a* to two opposite side edge portions 32 of the bottom plate 3.

Figure 6:
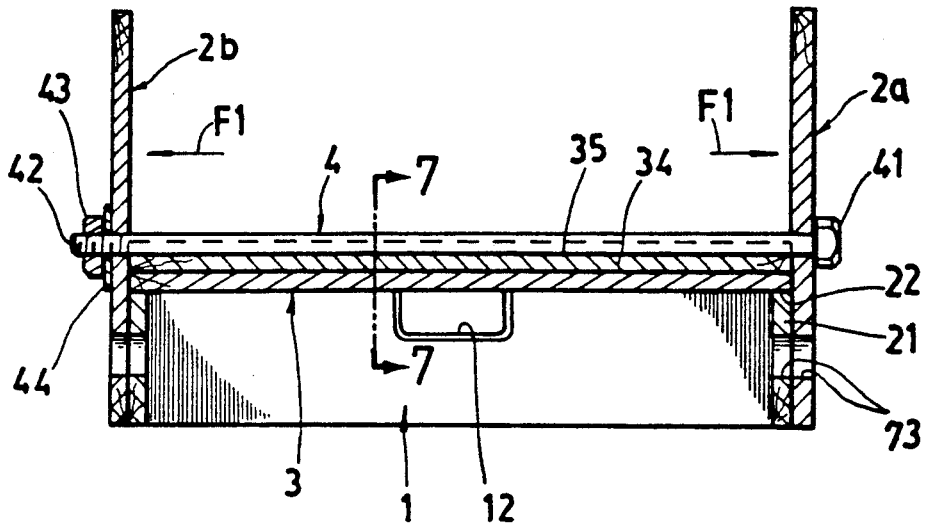
FIG. 6 is a sectional drawing of the present invention when viewed from 6—6 direction of FIG. 5.
Figure 7:
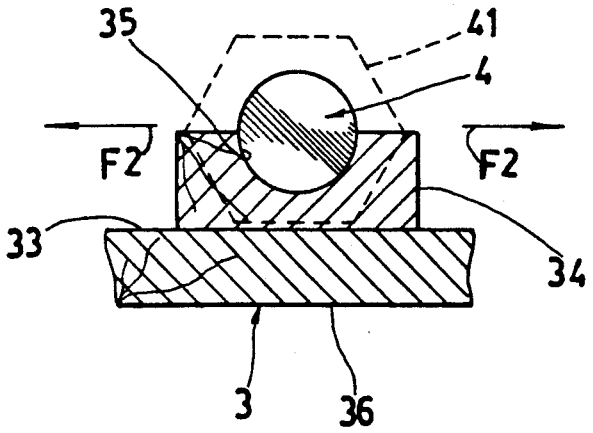
FIG. 7 is a partial sectional drawing of the present invention when viewed from 7—7 direction of FIG. 6.
Figure 8:
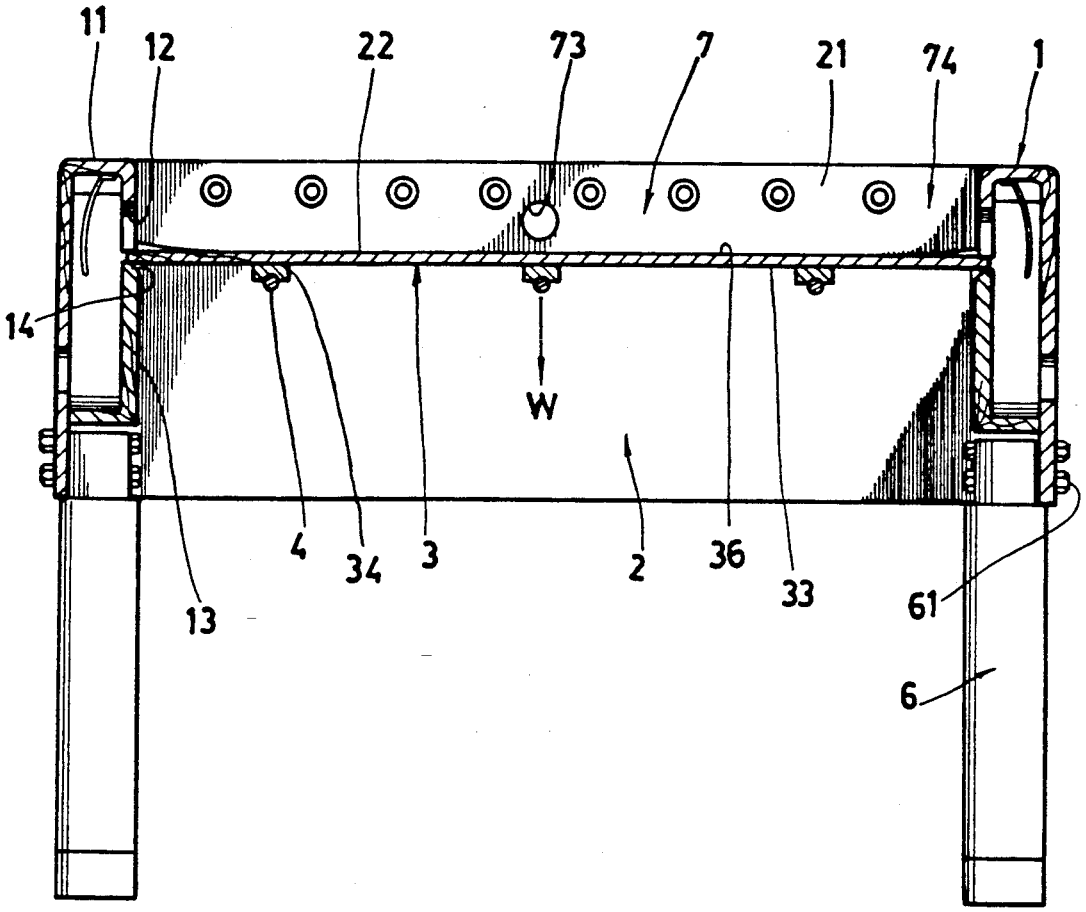
FIG. 8 is a longitudinal sectional drawing of the present invention when erected by inverting the table from FIG. 5.

In assembling the present invention as shown in FIGS. 4–7, the two end panels 1 are turned the upside down as shown in FIG. 4 and the bottom plate 3 is inserted in between the two end panels 1 by engaging each transverse end portion 31 of the bottom plate 3 with the slot 14 recessed in the end panel 1. Then, the two side panels 2 are moved to approximate the two longitudinal side edge portions 32 of the bottom plate 3 and by laying each longitudinal side edge portion 32 of the bottom plate 3 on the bottom edge portion 22 of each side panel 2. The fastening bolt 4 is then passed through the two panels 2 to be engaged with the groove 35 in each packing sleeve 34 secured on the bottom surface 33 of the bottom plate 3 as shown in FIGS. 6, 7 to firmly fastening the two side panels 2 with the bottom plate 3. By fastening the side panels 2 with the two end panels 1 by inserting screws 5 through the side panels 2 into the screw hole 10 of the end panels 1, the four panels 2, 1 plus the bottom plate 3 will be assembled from their knockdown state and four supporting leg members 6 are further secured on the bottom portion of the four panels 2, 1 for finishing the football table for playing purpose. After inverting the table from FIG. 5 to FIG. 8, the table can be erected for its playing use.

As shown in FIG. 4, all the panels 2, 1 and bottom plate 3 are inverted to be laid on a floor surface, so that the fastening bolts 4 can be easily inserted through the bolt holes 24 predrilled in the side panels 2 to be engaged with the grooves 35 recessed in the packing sleeves 34 for a convenient assembly of a complete set of the present invention. Any vibrational force such as a rightward-and-leftward vibrational force F1 as shown in FIG. 6 and a frontward-and-rearward vibrational force F2 as shown in FIG. 7 will be overcome since each fastening bolt 4 is snugly engaged will the groove 35 in the sleeve 34, which serves as a "packing" between the bolt 4 and the bottom plate (FIG. 7) and as a packing between the two side panels 2 as limited by the head portion 41 and the nut 42 on two opposite sides of the two panels 2 (FIG. 6), thereby forming a very stable assembled structure.

Figure 10:
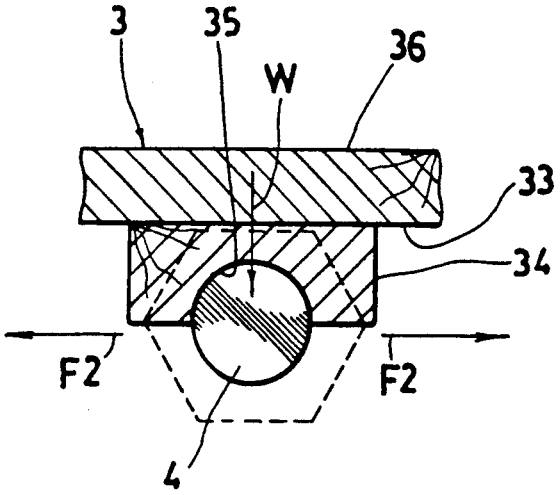
FIG. 10 is a partial sectional drawing of the present invention when viewed from 10—10 direction of FIG. 9.
Figure 9:
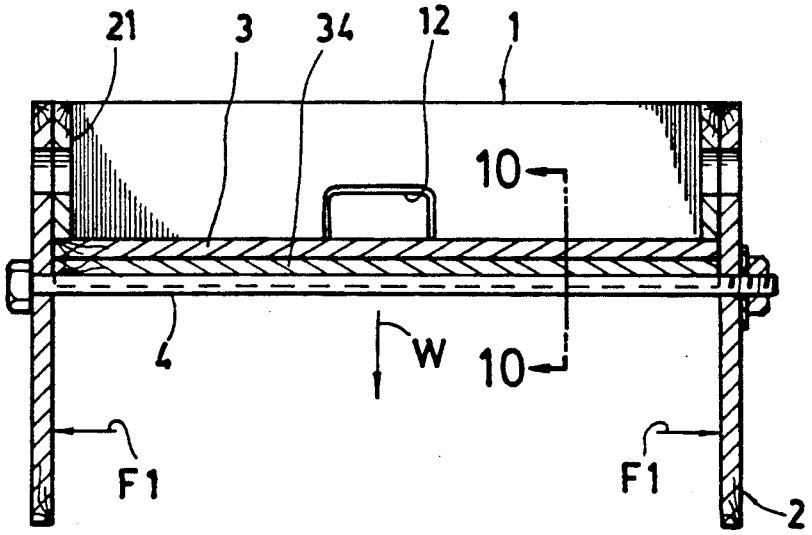
FIG. 9 is a sectional drawing of an erected table of the present invention as inverted from FIG. 6.

After inverting the assembled table from FIG. 5 to FIG. 8, the gravitational force W as effected by the weight of the table will act on the bolts 4 since the table with the bottom plate 3 and the packing sleeves 34 will snugly "ride" on the bolts 4 especially as shown in FIG. 9, 10 to further overcome or minimize any vibrational force such as the vibrational forces F1, F2 as shown in FIGS. 9, 10.

Figure 1:
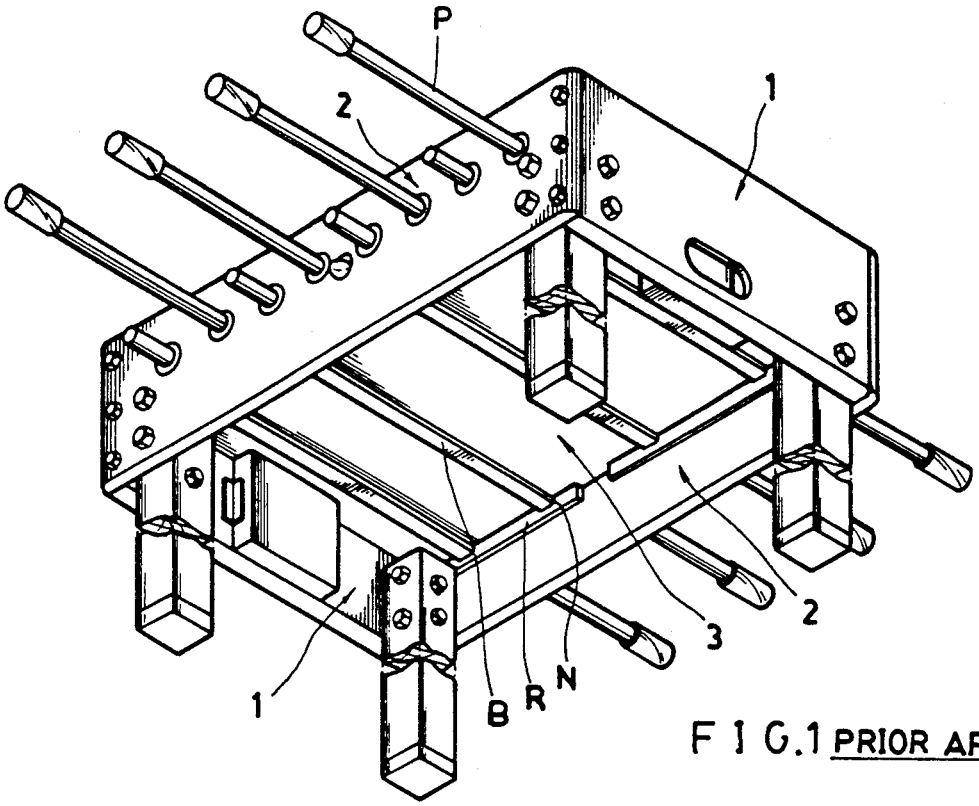
FIG.1 PRIOR ART
FIG. 1 shows a conventional football table.
Figure 2:
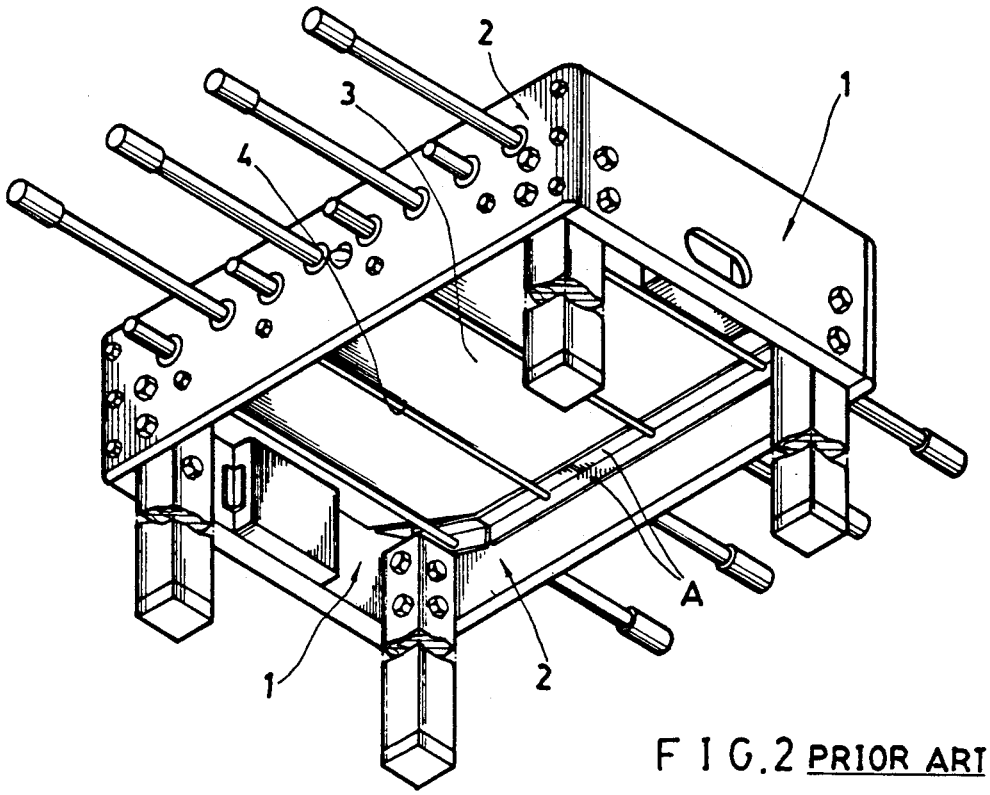
FIG.2 PRIOR ART
FIG. 2 shows another conventional football table.

Therefore, the present invention can provide a football table for quickly conveniently assembling the elements in construction of the table from their knockdown state, without reducing the assembling stability in comparison with the prior arts as shown in FIGS. 1, 2. However, the more complex angles A and ribs R of the conventional tables have been eliminated and saved in this invention to thereby ease the assembly work and to save the production cost. The consumers may buy the table from a store or shop at a lower selling cost to easily assemble it by do-it-yourself for interesting purpose. Meanwhile, all the panels 2, 1, bottom plate 3, leg members 6 are shipped or handled on their knockdown condition and can be packed into a compact package of small volume for saving shipping cost.

I claim:

1. A knockdown football table for playing purposes comprising:

a pair of end panels, a pair of side panels and a bottom plate combinable for forming a football playing field generally rectangular shaped, having four supporting leg members secured on a bottom portion of said end panels and said side panels;

each said end panel having an end wall portion bent inwardly downwardly from a vertical panel portion of said end panel to have a longitudinal section generally U shaped to be contiguous to the bottom plate, having a goal opening formed in a central portion of said end wall portion, a ball box positioned below said end wall portion and communicating with said goal opening for collecting a ball therein, and a transverse slot notched in between said end wall portion and said ball box for receiving a transverse end portion of said bottom plate;

each said side panel including: a reinforcing side plate having a height lower than that of the side panel integrally combined with the side panel and having a bottom edge portion longitudinally formed on a bottom portion of the reinforcing side plate contiguous to a longitudinal side edge portion of the bottom plate;

said bottom plate having a pair of said transverse end portions transversely formed on two opposite end portions of the bottom plate engageable with a pair of transverse slots with each said slot recessed in between a lower edge portion of said end wall portion of the end panel and said ball box, a pair of longitudinal side edge portions disposed on two opposite longitudinal side portions of the bottom plate; each said longitudinal side edge portion of said bottom plate engageable with the bottom edge portion of the reinforcing side plate of each said side panel when assembling the side panel with the bottom plate, a plurality of packing sleeves transversely juxtapositionally secured on a bottom surface of the bottom plate; each said packing sleeve having a groove longitudinally recessed in the sleeve to have a cross section of arcuate shape concave inwardly towards the bottom surface for snugly engaging a fastening bolt with the groove of the packing sleeve by passing the fastening bolt through each fastening bolt hole formed in the side panel, and a field surface formed on an upper surface of the bottom plate for marking features thereon for simulating a football field; and each said fastening bolt snugly engageable with the groove of the packing sleeve beneath the bottom plate and having a head portion formed on a first end of said fastening bolt retained on a first side panel by passing the fastening bolt through the first side panel to engage the groove in the packing sleeve and, with the screw portion formed on a second end of the fastening bolt protruding outwardly through a second side panel to be limited by a nut and a washer retained on the second side panel for fastening the second side panel and the first side panel to two opposite side edge portions of the bottom plate for firmly fastening the side panels with the bottom plate, and with said two side panels combinable with said two end panels by screws for forming a football table from a knock-down state thereof.

* * * * *